United States Patent [19]

Angress

[11] 4,133,149

[45] Jan. 9, 1979

[54] FOLDABLE PORTABLE SHELTER

[76] Inventor: Percy G. Angress, 481 Gayley Ave. #111, Los Angeles, Calif. 90024

[21] Appl. No.: 847,180

[22] Filed: Oct. 31, 1977

[51] Int. Cl.[2] ..... E04B 1/343

[52] U.S. Cl. ..... 52/70; 52/DIG. 10; 135/1 R

[58] Field of Search ..... 52/70, 71, DIG. 10, 52/80, 81, 64; 135/1 R

[56] References Cited

U.S. PATENT DOCUMENTS

| | | | |
|---|---|---|---|
| 2,670,986 | 3/1954 | Presnell | 52/71 X |
| 2,835,931 | 5/1958 | Sterkin | 52/70 |
| 3,332,178 | 7/1967 | Foster | 52/70 |
| 3,346,998 | 10/1967 | Nelson | 52/70 |
| 3,486,513 | 12/1969 | Fulsebakke | 52/71 X |
| 3,640,034 | 2/1972 | Shotwell | 52/70 |
| 3,759,277 | 9/1973 | Glade | 135/1 R X |
| 3,868,295 | 2/1975 | Boone | 52/DIG. 10 |
| 4,064,662 | 12/1977 | O'Toole | 52/71 |

*Primary Examiner*—J. Karl Bell
*Attorney, Agent, or Firm*—Max Geldin

[57] ABSTRACT

Foldable and portable shelter structure constructed from a rigid or semi-rigid, thin material such as cardboard, plastic, and the like, formed of a pair of hexagons, placed face-to-face and secured to each other, as by taping, along two or three of the contiguous outer edges of the hexagons. According to one embodiment, each hexagon is divided into six triangles, and the lines which separate these triangles are each flexible in one direction. The pair of hexagons can be pulled apart like a "party hat" and placed on a flat surface to form a standing shelter structure. A floor can be added as an integral part of the structure, which is at full strength when set up flat on the ground.

17 Claims, 21 Drawing Figures

FIG. 1
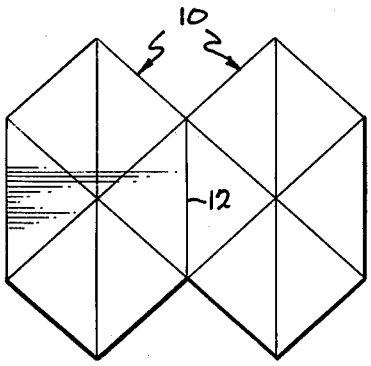
FIG. 3
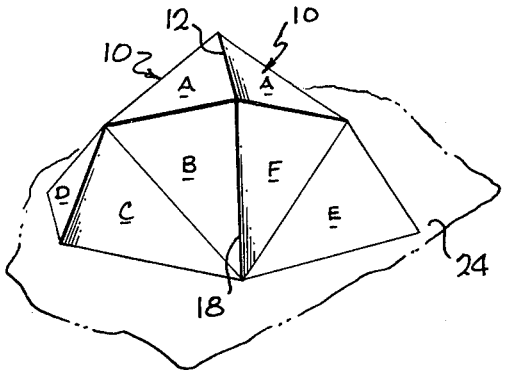
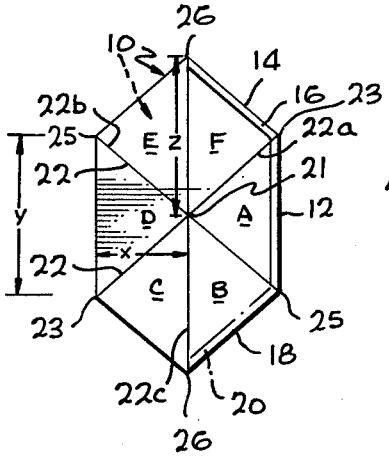
FIG. 2
FIG. 4
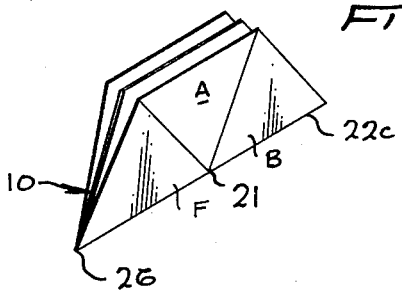
FIG. 6
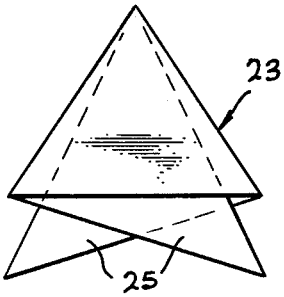
FIG. 5
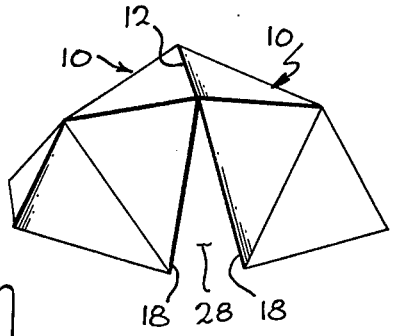
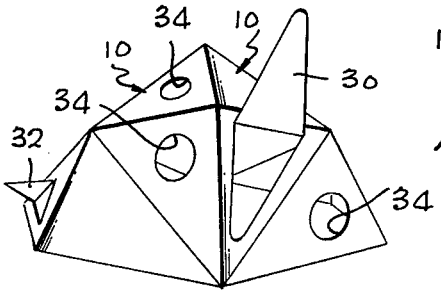
FIG. 7

FIG. 8
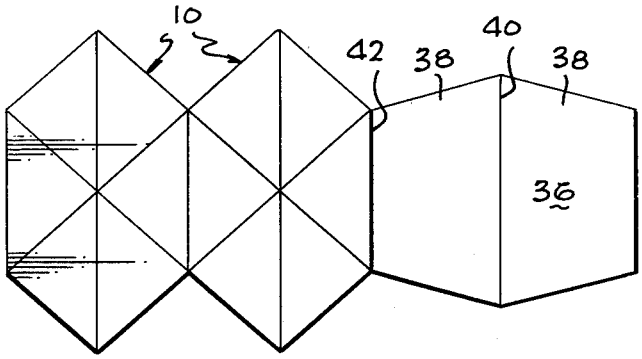
FIG. 8a
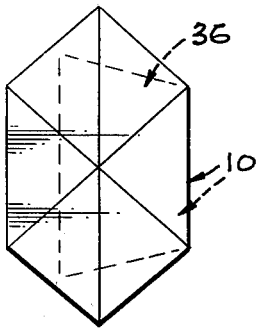
FIG. 9
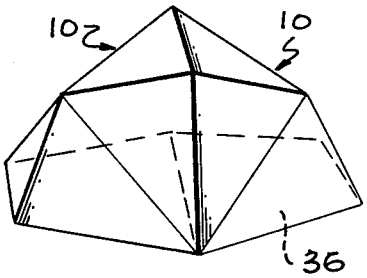
FIG. 10
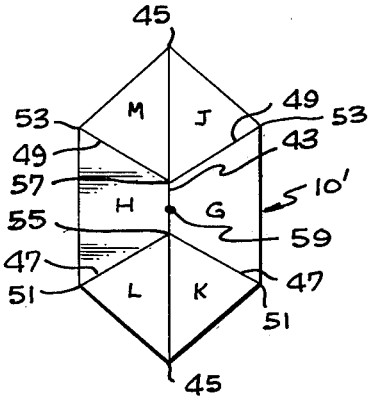
FIG. 11
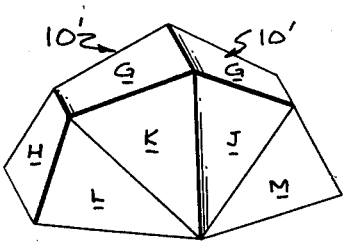
FIG. 13
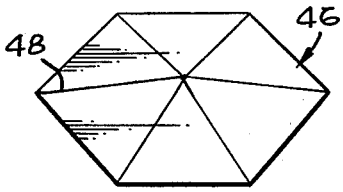
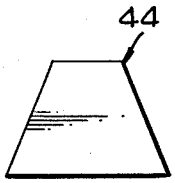
FIG. 12
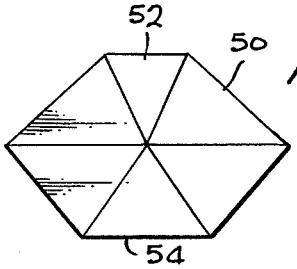
FIG. 14

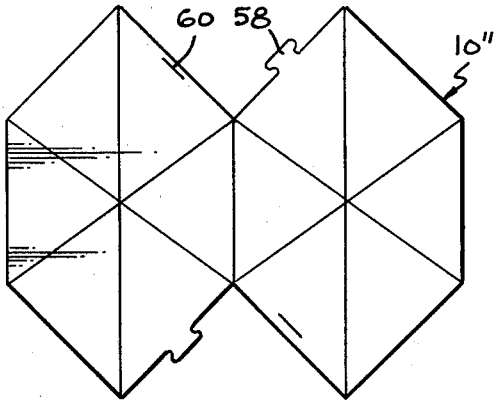
FIG. 15
FIG. 16
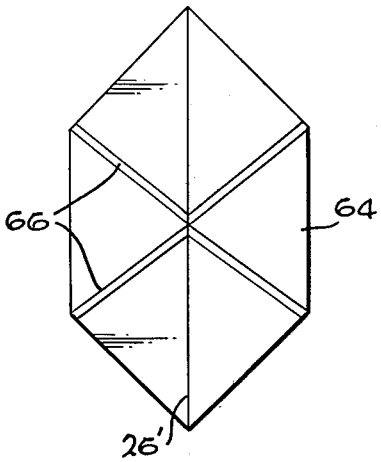
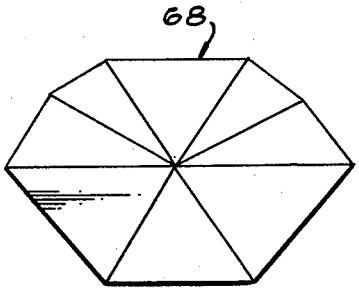
FIG. 17
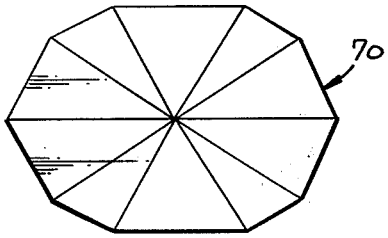
FIG. 18
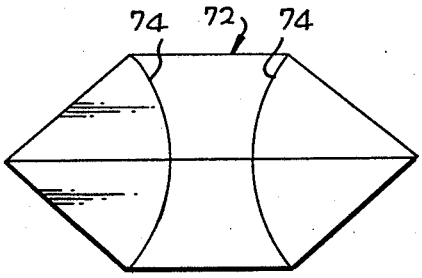
FIG. 19
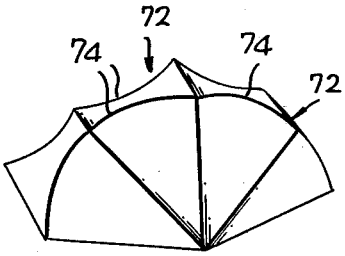
FIG. 20

FOLDABLE PORTABLE SHELTER

BACKGROUND OF THE INVENTION

This invention relates to portable shelters, and is particularly directed to foldable portable shelters which are easily erected and when no longer required, can be readily folded into a substantially planar form, and stored or transported for subsequent use.

Conventional portable shelters for the most part are in the form of tent structures requiring the use of stakes, guys, and other structural members for support. Such structures require substantial time to erect, and when disassembled after use and for transporting, such structures are generally bulky and require substantial space particularly for transporting.

More recently, portable, self-supporting and foldable shelters have been developed. Although such self-supporting structures are more readily erected than tents, they are still relatively complex and require a considerable number of parts, and in many instances are not readily foldable into a highly compact form, which requires a minimum amount of space for storage or transporting.

Illustrative of the prior art are the following patents: U.S. Pat. Nos. 2,835,931; 3,640,034; 3,016,115; 3,666,607; 3,332,178; 3,714,749; 3,534,513; and 3,759,277.

It is accordingly one object of the present invention to provide a foldable, portable shelter construction which can be made from inexpensive materials and which can be readily fabricated. Another object is the provision of a foldable, portable shelter of the above type, which is frameless and supported only by the skin or sides of the structure when placed upon the ground. A still further object of the invention is to provide a shelter or building structure of the above type which can be readily erected in a minimum amount of time, and when no longer used, can be as readily folded into a compact substantially planar structure which occupies a minimum of space for storage or transporting.

SUMMARY OF THE INVENTION

A foldable, portable shelter of simple design and which can be readily fabricated from relatively inexpensive available materials such as cardboard, for example, is provided according to the invention employing as an essential feature, a pair of hexagons, which are placed face-to-face and secured to each other along two or three of the contiguous outer edges of the adjacent hexagons. According to one embodiment, each hexagon is divided into six triangles, the lines separating such triangles being flexible in one direction. The lines or borders between adjacent triangles can simply represent folds in a solid, one-piece hexagon, or may be where two separate triangles are joined together by some other means such as taping.

The so-joined face-to-face pair of hexagons can be pulled apart like a "party hat" and placed on a flat surface to form a standing structure. A floor can be added as an integral part of the shelter structure. The structure is at full strength when set up flat on the ground. When not required for further use, the structure has the ability to fold down into a number of different positions, as illustrated hereinafter, each of such positions placing the structure in substantially planar form. Certain of these positions are more compact than others and in any of such planar positions the folded structure requires a substantially reduced amount of space for storing and transporting. According to another modification of the invention, instead of each hexagon being in the form of six triangles, each of the two middle triangles of each hexagon can be extended into the form of a trapezoid. This latter structure has the advantage that when properly proportioned it will fold down into an even more compact package than the structure in which the hexagons are each formed of six triangles.

The shape of the two hexagons can be altered by changing the three variable dimensions in the hexagon. Further, the two hexagons can have varying shapes while still yielding standing structures, although not all of them will fold down into the most compact positions. In further variations of the design of the foldable structure, the two hexagons can be unequal in area, while in other variations the two hexagons each can have curved folding lines, instead of straight lines formed by lines between adjacent triangles.

In still other variations, polygons other than hexagons can be employed such as octagons and decagons, comprised of eight and ten triangles respectively, with foldable lines between triangles.

The individual sections, e.g. triangles, of the polygons or hexagons can be joined together by tape, hinges, or flexible material molded into the seams. Spacers for accommodation of inner parts can be provided, e.g. between the adjacent triangles of each hexagon.

Accordingly, the basic foldable portable shelter structure of the invention is comprised of a pair of polygons, preferably hexagons, disposed in face-to-face relation, and secured to each other along at least two contiguous edges of the polygons, each of the polygons containing a plurality of fold lines or joints, and permitting flexing of the portions of each of said polygons bounded by said fold lines, whereby said polygons can be pulled apart and placed on a flat surface to form a standing shelter structure, and such standing structure can be folded together into a compact substantially planar form.

The foldable structure of the invention can be made from cheap material such as cardboard, paper, plastic, wood, and metal, and can be of any size, limited only by the strength of the material form which it is constructed. The structure is comprised of a minimum number of parts, requiring no frames or other structural components and is quickly erected and disassembled as desired. The structure of the invention has numerous applications, including recreational use for camping, as a playhouse or garden hut, as an inexpensive, sturdy emergency shelter, easy to manufacture and transport in large numbers, as booths or shelters at large, temporary gatherings of people such as at conferences, concerts and fairgrounds, as a seasonal shelter to set up and live in for a period of weeks, such as over the summer, and also as a permanent pre-fabricated building which can be transported to the site, and set up there. When employed as a permanent pre-fabricated building, the structure can be made for example, from a composite of plastic layers on the outside, and honeycomb structure on the inside, with insulation.

BRIEF DESCRIPTION OF THE DRAWINGS

FIG. 1 is a plan view of a pair of hexagons joined together along one edge and employed in fabricating the foldable portable shelter structure, according to one embodiment of the invention;

FIG. 2 is a plan view of the pair of hexagons shown in FIG. 1, placed in face-to-face folded relation;

FIG. 3 shows the pair of hexagons of FIGS. 1 and 2, pulled apart along the fold lines forming the adjacent edges of the triangles in each of the hexagons, and placed on a flat surface to form the standing structure;

FIG. 4 illustrates the structure of FIGS. 2 and 3, folded along the central line of each of the hexagons in FIG. 2;

FIG. 5 illustrates the completely folded down structure of FIGS. 2 and 3, where the two hexagons of FIG. 2 are joined only along two adjacent edges;

FIG. 6 illustrates the unfolded structure of FIG. 2 where the hexagons are joined along only two edges, to provide an opening in the structure;

FIG. 7 shows the unfolded structure illustrated in FIG. 3, and containing a door and windows cut into the structure;

FIG. 8 illustrates the structure shown in FIG. 1 and including a floor as an integral part of the structure;

FIG. 8*a* illustrates the folded up positions of the structure of FIG. 8, corresponding to FIG. 2, with the floor inside;

FIG. 9 illustrates the structure of FIG. 8 unfolded with the floor inside;

FIG. 10 shows a modification of the structure illustrated in FIG. 2, wherein the two middle triangles of the hexagons have each been extended into a trapezoid;

FIG. 11 shows the pulled-apart or unfolded structure of FIG. 10;

FIG. 12 illustrates the completely folded down structure of FIGS. 10 and 11;

FIGS. 13 and 14 illustrate further modifications of the structure of FIG. 2;

FIG. 15 illustrates the use of a tab and slot system for securing the adjacent hexagons of the structure of FIG. 2 together, instead of using tape for this purpose;

FIG. 16 illustrates the structure of FIG. 2, employing spacers between certain of the triangles of the hexagons;

FIGS. 17, 18 and 19 illustrate further modifications of the hexagon structure shown in FIG. 2; and FIG. 20 illustrates the pulled-apart or unfolded shelter structure of FIG. 19.

DETAILED DESCRIPTION OF ILLUSTRATIVE EMBODIMENTS

Referring to FIG. 1 of the drawing, a frameless, skin-supported shelter structure is provided employing a thin, rigid or semi-rigid material such as cardboard, consisting of a pair of hexagons 10 which are symmetrical and are of the same size and dimensions, each hexagon 10 consisting of six triangles.

As seen in FIG. 2, the hexagons 10 are placed face-to-face and secured to each other along two contiguous outer edges 12 and 14 of the hexagons, as by means of tape as indicated at 16, or optionally along a third contiguous outer edge 18, also by means of tape as indicated by dotted line 20. As seen in FIGS. 1 and 2, each of the hexagons is divided into six triangles A, B, C, D, E and F. The lines 22 which separate these triangles represent folds in the cardboard and such lines or folds are each flexible in one direction. The two hexagons are also separable from each other along the outer contiguous edges 12, 14 and 18, but are held together by the tapes 16 and 20 along these edges. Alternatively, the two hexagons 10 can be integrally formed of a single sheet secured together along one common foldable edge 12, as seen in FIG. 1, the other adjacent contiguous edges 14, or 14 and 18, being secured together as by taping, as seen in FIG. 2.

If desired, although the hexagons 10 are preferably each in the form of one integral sheet, with the folds 22 formed between adjacent triangles, the triangles of each hexagon can be separately formed and secured together by tape along the adjacent edges 22 to hold the triangles together while permitting foldability along the lines or edges 22 separating the triangles.

It will be noted that the six triangles A through F of each hexagon have a common central apex 21, the folds 22 separating such triangular portions being formed by three lines 22*a*, 22*b* and 22*c* connecting three pairs of opposite corners 23, 25 and 26, respectively, of each of the hexagons, one pair of the corners 26 being spaced further apart than the two other pairs of corners 23 and 25, the line 22*c* connecting the furthermost opposite corners 26 of each hexagon being the center line. The pair of triangles A and D thus formed are central triangles, each of the other two pairs of triangles B, C and E, F being disposed on opposite sides of the central triangles A and D, each pair of the above three pairs of triangles being symmetrical about central line 22*c*.

As illustrated in FIG. 3, the pair of hexagons 10 can be pulled apart or unfolded like a "party hat" and placed on a flat surface or the ground 24 to form the standing structure shown in FIG. 3. The unfolded structure of FIG. 3 is at full strength when set up flat on the ground.

The structure of FIG. 3, when no longer needed or in use, can be folded back to the two-piece hexagon structure of FIG. 2, and the adjacent half of each hexagon can then be folded up along the center line 22*c* to yield a more compact package, four layers thick, as seen in FIG. 4.

Where the two hexagons 10 are joined along only two edges as at 12 and 14 in FIG. 2, then the structure can be folded up into a more compact package 23 having feet 25, as seen in FIG. 5, which is 12 layers thick. The folding procedure is almost automatic, as there is only one way that such structure will fold down into such package. The fact that the hexagons 10 are joined to each other along only two edges 12 and 14 as seen in FIG. 2 not only permits the above-noted highly-compact folded-down position thereof shown in FIG. 5, but also provides for an adjustable entrance, as illustrated at 28 in FIG. 6, when the hexagons are pulled apart to form the standing structure, as noted above. The adjustable entrance 28 is formed by the unattached contiguous edges 18 of the two hexagons 10, as seen in FIG. 2. If desired, a closure or flap (not shown) can be placed over such entrance.

Referring to FIG. 7, doors 30 and 32 and windows 34 can readily be cut into the triangles of the hexagons 10 forming the shelter structure.

Further, as illustrated in FIGS. 8, 8*a* and 9, a floor indicated at 36 in FIG. 8, can be provided in the structure, the floor also being formed of a thin sheet material such as cardboard, and comprised of a pair of trapezoids 38 foldable along the common edge 40, the outer edge of one of the trapezoids 38 being foldably secured to an outer edge of one of the hexagons 10, as at 42, e.g. by taping, or alternatively the floor 36 and the hexagons 10 can be formed of a single sheet of cardboard, to form an integral structure which is foldable along the common edge 42. The structure of FIG. 8 can be folded together with the hexagons 10 in face-to-face relation, as in FIG. 2, and with the floor 36 folded along line 40 and positioned on the inside between the pair of hexagons 10, as illustrated in dotted lines in FIG. 8*a*. When the structure of FIG. 8*a* is pulled apart to form the standing shelter structure, as shown in FIG. 9, the floor 36 is completely unfolded, as indicated in dotted lines in FIG. 9.

The structure illustrated in FIG. 3 and formed of the hexagons 10 containing the triangles foldable along their adjacent edges, provides an increased volume to surface ratio as compared to many alternative prior art designs, while at the same time this simple structure remains stable and does not tend to collapse when erected. When made from cardboard or other insulating materials, a structure of this type can retain heat much better than a cloth structure such as a tent. If the hexagon-type structure of the invention is treated on its outer surface with a reflective coating, this will cool the interior of the structure.

By varying the shapes of the two hexagons 10, the shape of the structure can be altered. For hexagons 10, there are three variable dimensions, illustrated in FIG. 2 as X, Y and Z. In preferred practice, length Y of the opposite parallel sides of each hexagon corresponding to the bases of the central triangles A and D, is usually a little longer than length X, the height of the central triangles between the bases thereof and the common apex 21 of such triangles. Two satisfactory X:Y ratios are for example, 3:4 and 5:7. However, if desired, the length of X and Y can be substantially the same, or X can be somewhat larger than Y. In preferred practice, in order for the structure to fold down into the smallest package, length Y should be larger than, for example, about 1.15 times length X. Although the length of Z, the distance between central apex 21 and the respective furthermost corners 26, will not affect foldability, it will, however, affect stability. Generally, Z is about 1.5 to about 2 times the length of X.

FIGS. 10, 11 and 12 illustrate a modification of the design of the foldable, portable shelter of FIGS. 1 to 5. The structure of FIGS. 10 to 12 differs from the structure of FIGS. 1 to 5 in that the two middle or central triangles A and D of the hexagons 10 in FIG. 2 are extended into trapezoids G and H. Thus, the symmetrical hexagons 10' in FIG. 10 are composed of the four triangles, J, K, L and M, and the trapezoids G and H. The pair of trapezoids G and H are formed by the center line 43 connecting the two furthermost corners 45 of the hexagons, and lines 47 and 49 connecting each pair of corners 51 and 53, respectively, to the center line 43, at points 55 and 57, respectively, such points being spaced apart on opposite sides of the center 59 of center line 43. The two trapezoids G and H, and the two pairs of triangles K, L and J, M disposed on opposite sides of hexagons 10' being symmetrical about central line 43.

When hexagons 10' are pulled apart, and placed on a flat surface or the ground, it forms the structure of FIG. 11, similar to that of FIG. 3. When the structure of FIG. 11 is folded down it forms a compact package, as illustrated at 44 in FIG. 12, which is even more compact than the package illustrated in FIG. 5 in that the "feet" 25 in the package of FIG. 5 are fully withdrawn in the folded package 44 of FIG. 12.

In the structure of FIGS. 2 and 10, the hexagons 10 and 10' and the fold-lines formed between the triangles of FIG. 2, and between the triangles and the trapezoids of FIG. 10 are symmetrical. In FIGS. 13 and 14 the hexagon shapes are shown as unsymmetrical. Thus, in FIG. 13 the hexagons 46 have a bent central line 48, and in FIG. 14, the hexagons have unequal top and bottom edges 52 and 54, respectively. Although irregular hexagon shapes of the types shown in FIGS. 13 and 14 generally yield standing structures, not all of them will fold down into the smallest position. It will be understood that other types of irregular hexagons can be provided which will also yield standing structures, including hexagons which have non-parallel top and bottom edges, or wherein the central line corresponding to line 22*c* in FIG. 4 is longer on one side of the midpoint 21 than on the other side. These irregular hexagons also will form standing structures of somewhat different design from that shown in FIG. 3.

FIG. 15 illustrates a modification of the structure shown in FIGS. 1 and 2, and wherein the hexagons 10" are provided with a tab and slot system 58, 60 along contiguous or adjacent edges in adjacent hexagons, to form a tapeless, ready-to-set-up structure like that shown in FIG. 3.

FIG. 16 illustrates the use of hexagons 64 similar to hexagons 10 in FIG. 2, but wherein spacers 66 are provided between adjacent triangles on each side of the central line 26' of each hexagon, for accommodation of the inner parts when the shelter is folded down to its smallest position. The spacers can be formed of the same rigid or semi-rigid materials as the polygons or hexagons.

Although in preferred practice the foldable, portable shelter of the invention is comprised of hexagons, other polygonal shapes can be employed such as the octagon-shaped variation 68 of FIG. 17 or the decagon-shaped variation indicated at 70 in FIG. 18.

Further, hexagons such as illustrated at 72 in FIG. 19 can be provided with curved fold lines 74 instead of the straight fold lines provided between the triangles of FIG. 2. The hexagons 72 in FIG. 19, attached and folded in face-to-face relation, as in FIG. 2, can be unfolded and set up on the ground to provide the shelter structure shown in FIG. 20.

Although the polygons of the foldable structure of the invention preferably are formed of thin material, as previously noted, such polygons for certain applications, e.g. a relatively large structure, can be formed of relatively thick material to provide relatively thick walls.

From the foregoing, it is seen that the invention provides a simple highly versatile foldable, portable shelter or building structure fabricated form cheap, readily available materials, which is frameless, and which can be set up rapidly to form a shelter, and following its use for this purpose, can be readily folded down into a highly compact form for storage or transportation.

While I have described particular embodiments of my invention for purposes of illustration, it is understood that other modifications and variations will occur to those skilled in the art, and the invention accordingly is not te be taken as limited except by the scope of the appended claims.

What is claimed is:

1. A foldable, portable shelter structure which comprises a pair of polygons ranging from hexagons to decagons and formed of a rigid or semi-rigid material disposed in face-to-face relation and secured to each other along at least two contiguous outer edges of said polygons, each of said polygons containing a plurality of fold lines and permitting flexing of the portions of each of said polygons bounded by said fold lines, whereby said polygons can be pulled apart and placed on a flat surface to form a standing shelter structure, and such standing structure can be folded together into a compact substantially planar form.

2. The structure as defined in claim 1, said fold lines being straight fold lines.

3. The structure as defined in claim 1, said polygons secured to each other along three contiguous outer edges.

4. The structure as defined in claim 1, wherein said polygons are each hexagons formed of a thin rigid or semi-rigid material, said hexagons being divided into a plurality of triangular shaped portions, said fold lines separating said triangular-shaped portions and forming the boundaries thereof.

5. The structure as defined in claim 4, said hexagons secured to each other along two contiguous edges, and providing an opening in said structure along a third contiguous edge between said polygons in said standing structure and permitting the disassembled shelter structure to be folded together into a compact package several layers thick.

6. The structure as defined in claim 4, said hexagons secured to each other along three contiguous edges, permitting the dissassembled shelter structure to be folded together into a compact package several layers thick.

7. The structure as defined in claim 4, said hexagons being secured to each other along said at least two contiguous outer edges by taping.

8. The structure as defined in claim 4, said hexagons being symmetrical, each hexagon comprising six triangles having a common central apex, said folds separating the triangular shaped portions being formed by three lines each connecting one pair of three pairs of opposite corners of each of said hexagons, one pair of said opposite corners being spaced farther apart than the two other pairs of opposite corners, all of said lines passing through the center of said hexagons and forming said common central apex of said triangles, one of said lines connecting said furthermost pair opposite or corners of said hexagons being a center line, and forming a pair of central triangles and two pairs of outer triangles, each of said two pairs of outer triangles being disposed on opposite sides of said central triangles, each pair of said three pairs of triangles being symmetrical about said central line.

9. The structure as defined in claim 4, said hexagons being symmetrical, each of said hexagons comprising four triangles and a pair of trapezoids, said four triangles and said pair of trapezoids being formed by a center line connecting the two furthermost corners of each of said hexagons, and a plurality of lines connecting each of the other corners of said hexagons to a pair of points on said center, said points being spaced apart on opposite sides of the center of said center line, forming two pairs of triangles disposed on opposite sides of the hexagons, the two triangles of each of said pairs of triangles being symmetrical about said central line, and said pair of trapezoids being positioned in the center of said hexagons between the two pairs of triangles, said trapezoids being symmetrical about said center line.

10. The structure as defined in claim 4, said hexagons being formed of an integral sheet of said material and secured together along a common edge forming a fold line between said hexagons.

11. The structure as defined in claim 4, including a portion secured along one edge of one of said hexagons and forming a fold line, said last-mentioned portion forming the floor in said structure when said hexagons are pulled apart to form a standing structure, and said floor being foldable between said hexagons when said hexagons are folded together in face-to-face relation.

12. The structure as defined in claim 8, the length of the opposite parallel sides of the hexagons corresponding to the bases of the central triangles of each hexagon being longer than the height of said central triangles between said bases thereof and said common apex of said triangles.

13. The structure as defined in claim 12, said length being greater than about 1.15 times said height.

14. The structure as defined in claim 12, said center line being about 1.5 to about 2 times said height of said central triangles.

15. The structure as defined in claim 4, said hexagons being unsymmetrical.

16. The structure as defined in claim 1, said fold lines being curved fold lines.

17. The structure as defined in claim 4, said hexagons being secured to each other along said at least two contiguous outer edges by a tab and slot connection.

* * * * *